US010685827B2

(12) United States Patent
Cheng et al.

(10) Patent No.: US 10,685,827 B2
(45) Date of Patent: Jun. 16, 2020

(54) QUADRUPOLE ION TRAP APPARATUS AND QUADRUPOLE MASS SPECTROMETER

(71) Applicant: ACROMASS TECHNOLOGIES, INC., Taipei (TW)

(72) Inventors: Chun-Yen Cheng, Qionglin Township Hsinchu County (TW); Yao-Hsin Tseng, Taipei (TW); Szu-Wei Chou, Hualien (TW); Yi-Kun Lee, Hsinchu (TW); Shih-Chieh Yang, Taichung (TW); Hung-Liang Hsieh, Taipei (TW)

(73) Assignee: ACROMASS TECHNOLOGIES, INC., Taipei (TW)

( * ) Notice: Subject to any disclaimer, the term of this patent is extended or adjusted under 35 U.S.C. 154(b) by 0 days.

(21) Appl. No.: 16/336,426

(22) PCT Filed: May 8, 2018

(86) PCT No.: PCT/US2018/031642

§ 371 (c)(1),
(2) Date: Mar. 25, 2019

(87) PCT Pub. No.: WO2018/208810

PCT Pub. Date: Nov. 15, 2018

(65) Prior Publication Data

US 2019/0228960 A1 Jul. 25, 2019

Related U.S. Application Data

(60) Provisional application No. 62/503,441, filed on May 9, 2017.

(51) Int. Cl.
*H01J 49/02* (2006.01)
*H01J 49/42* (2006.01)

(52) U.S. Cl.
CPC ..... *H01J 49/424* (2013.01); *H01J 49/027* (2013.01); *H01J 49/02* (2013.01)

(58) Field of Classification Search
CPC ..... H01J 49/424; H01J 49/027; H01J 49/02
See application file for complete search history.

(56) References Cited

U.S. PATENT DOCUMENTS 5,457,315 A 10/1995 Wells et al.
5,739,530 A * 4/1998 Franzen ..... H01J 49/063 250/282

(Continued)

FOREIGN PATENT DOCUMENTS

GB 2 403 845 A 1/2005
WO 2010/034630 A2 4/2010
WO 2014/183105 A1 11/2014

OTHER PUBLICATIONS

International Search Report issued in PCT/US2018/031642, dated Jul. 30, 2018 (2 pages).

*Primary Examiner* — Nicole M Ippolito
*Assistant Examiner* — Sean M Luck
(74) *Attorney, Agent, or Firm* — Hamre, Schumann, Mueller & Larson, P.C.

(57) ABSTRACT

A quadrupole ion trap apparatus includes a main electrode, a first end-cap electrode, a second end-cap electrode, and a phase-controlled waveform synthesizer. The phase-controlled waveform synthesizer generates a main RE waveform for the main electrode. The main RE waveform includes a plurality of sinuous waveform segments each of which is a part of a sine wave, and a plurality of phase conjunction segments each of which is non-sinuous. Each of the sinuous waveform segments is bridged to another sinuous waveform segment via one of the phase conjunction (Continued)

segments, so as to perform ordering of micro motions of sample ions trapped by the electrodes.

17 Claims, 19 Drawing Sheets

(56) References Cited

U.S. PATENT DOCUMENTS

| | | | | |
|---|---|---|---|---|
| 5,818,055 | A * | 10/1998 | Franzen | H01J 49/065 250/292 |
| 7,456,396 | B2 * | 11/2008 | Quarmby | H01J 49/427 250/292 |
| 9,105,458 | B2 | 8/2015 | Trimpin et al. | |
| 2005/0023461 | A1 * | 2/2005 | Schubert | H01J 49/067 250/306 |

* cited by examiner

QUADRUPOLE ION TRAP APPARATUS AND QUADRUPOLE MASS SPECTROMETER

CROSS-REFERENCE TO RELATED APPLICATION

This application claims priority of U.S. Provisional Patent Application No. 62/503,441, filed on May 9, 2017.

FIELD

The disclosure relates to mass spectrometry (MS), and more particularly to a quadrupole ion trap (QIT) mass spectrometer.

BACKGROUND

QIT mass spectrometers play a central role in the success of mass spectrometric methods for ionized molecules, macromolecules and biomolecules. Generally, a conventional QIT mass spectrometer includes a quadrupole ion trap (QIT) composed of a hyperbolic ring electrode and two hyperbolic end-cap electrodes to confine ionized particles therein. The ring electrode is fed with a main radio frequency (RF) waveform, and the two end-cap electrodes are fed with an auxiliary waveform, thereby trapping the ionized particles.

In a conventional method for mass spectrometry, the RF field is held at a constant frequency, and thus around a center of the QIT, the motion of trapped ionized particles approximately obeys the Mathieu equation both radially and axially. In practice, since buffer gas cooling may be used to slow down the motion of ionized particles for better motion control, a damping correction due to buffer-gas cooling can be added to the Mathieu equation as shown in Equation (1) below.

$$\frac{d^2u}{dt^2} + (a - 2q\cdot\cos(2\xi(t)))u + \gamma\frac{du}{dt} = 0;\ \text{where}\ \ 2\xi(t) = \int^{t}\Omega(x)dx; \tag{1}$$

$$q = q_z = \frac{8\ \text{eV}}{m/z(r_0^2 + 2z_0^2)\Omega^2};\ a = a_z = \frac{-16eU}{m/z(r_0^2 + 2z_0^2)\Omega^2};$$

$$q_z = -2q_r;\ a_z = -2a_r;\ \frac{2\tilde{\omega}}{\Omega} = \beta(q, \bar{a});\ \text{and}\ \ \bar{a} = a - \kappa(\gamma, \Omega)^2;$$

and the symbols used above are defined as follows:

u: r or z, the former and the latter respectively representing displacements of sample ion motion in radial direction and z-direction;

$r_0$: inner size of the QIT in radial direction;

$z_0$: inner size of the QIT in z-direction;

$2\xi$: phase of the main RF waveform;

e: elementary charge;

m/z: mass-to-charge ratio of the ionized/charged particle (m: mass, z: charge);

V: amplitude of main RF waveform;

$\Omega$: frequency of main RF waveform (angular);

U: DC offset of main RF waveform;

$\beta$: a function of q and a, noting that $\beta/2$ is a ratio of a frequency of secular motion of the ionized/charged particle to a frequency of the main RF waveform;

$\gamma$: damping constant due to gas collision;

$\kappa$: damping coefficient, which is related to $\gamma$;

$\tilde{\omega}$: secular frequency (angular); and $$u = \sum_{-\infty}^{\infty} u_n = \sum_{-\infty}^{\infty} C_n\cdot\exp(i\cdot(-\beta + 2n)\xi), \tag{1.1}$$

where $C_n$ is a coefficient denoted for $n^{th}$ component of ion displacement.

A closed-orbit solution (Equation (1.1)) is thus multi-periodic (composed of a period of RF field, and a period of secular motion of ion), as depicted in a stable region by the q-a diagram shown in FIG. 1. When the main RF waveform is applied in a manner as to let values of q and a fall outside the stable region, motions of the charged particles may become instable and the charged particles may be ejected out of the quadrupole ion trap. For a small amount (less than a few hundred in number) of molecular sample ions (or less than a few hundred in elementary charges) in a QIT having a stable gas flow and a slowly-ramping RF amplitude, highly sensitive mass spectrometry (MS) with a resolution over one thousand can be achieved.

When the number of molecular sample ions is increased to the thousands (such as MALDI sample ions) and the charges of the molecular sample ions are increased (such as LIAD sample ions), the sample ion-ion interactions become non-negligible, intervene in the kinetics of buffer gas cooling, and induce additional randomness upon the spectrometric path for mass discrimination within the q-a diagram. Therefore, the spectral outcome may become rather scattered, besides having substantial deviations, much away from what has been considered ideal according to the Mathieu equation.

In order to avoid scattered mass spectral outcome with substantial deviations from ideal location of mass spectral peaks, the ion-ion interaction is re-formulated into the collisional damping as being represented as a stochastic cut-off. Then, the dynamical equation of trapped ions uses the definite phase of main RF field as an independent variable, and thus an inherent dispersion can be explicitly discerned. Thus, to maintain the interpretation of simple Mathieu equation, advanced modulation process and detection technique were developed for such "ion cloud" spectrometry.

Either with molecular ions injected into the QIT or with molecules directly ionized inside the QIT, from the q, a values of ion motion, instability of molecular ions can be discerned within a few RF cycles. Constant-frequency trapping coincides ion's dynamics (i.e., the dynamical equation) wish the Mathieu equation, and is to use amplitude ramping in the main RF amplitude for linear mass spectrometry. Efficient cooling through gas collisions makes high-resolution mass spectrometry feasible, as if the kinetic deviation in accuracy can be calibrated or neglected. However, adjustable magnification for the amplitude of the main RF waveform has physical limitations, so mass scan is limited within a relatively small range.

SUMMARY

Therefore, an object of the disclosure is to provide a QIT apparatus that can alleviate at least one of the drawbacks of the prior art.

According to the disclosure, the quadrupole ion trap (QIT) apparatus includes a main electrode, a first end-cap electrode, a second end-cap electrode, and a phase-controlled waveform synthesizer. The main electrode surrounds a QIT axis extending along an axial direction. The first end-cap electrode and the second end-cap electrode are mounted to opposite sides of the main electrode in the axial direction, and cooperate with the main electrode to define a trapping space for trapping sample ions therein. The phase-controlled waveform synthesizer is electrically connected to the main electrode, and is configured to generate a main radio frequency (RF) waveform for the main electrode. The main RF waveform includes a plurality of sinuous waveform segments each of which is a part of a sine wave, and a plurality of phase conjunction segments each of which is non-sinuous. Each of the sinuous waveform segments is bridged to another one of the sinuous waveform segments via one of the phase conjunction segments, so as to perform ordering of micro motions of the sample ions trapped in the trapping space.

Another object of the disclosure is to provide a QIT mass spectrometer that can alleviate at least one of the drawbacks of the prior art.

According to the disclosure, the QIT mass spectrometer includes a QIT apparatus of this disclosure, and a charge-sensing particle detector. The charge-sensing particle detector is mounted to the second end-cap electrode of the QIT apparatus to sense charges of the sample ions ejected from said QIT apparatus.

BRIEF DESCRIPTION OF THE DRAWINGS

Other features and advantages of the disclosure will become apparent in the following detailed description of the embodiment (s) with reference to the accompanying drawings, of which.

DETAILED DESCRIPTION

Figure 1:
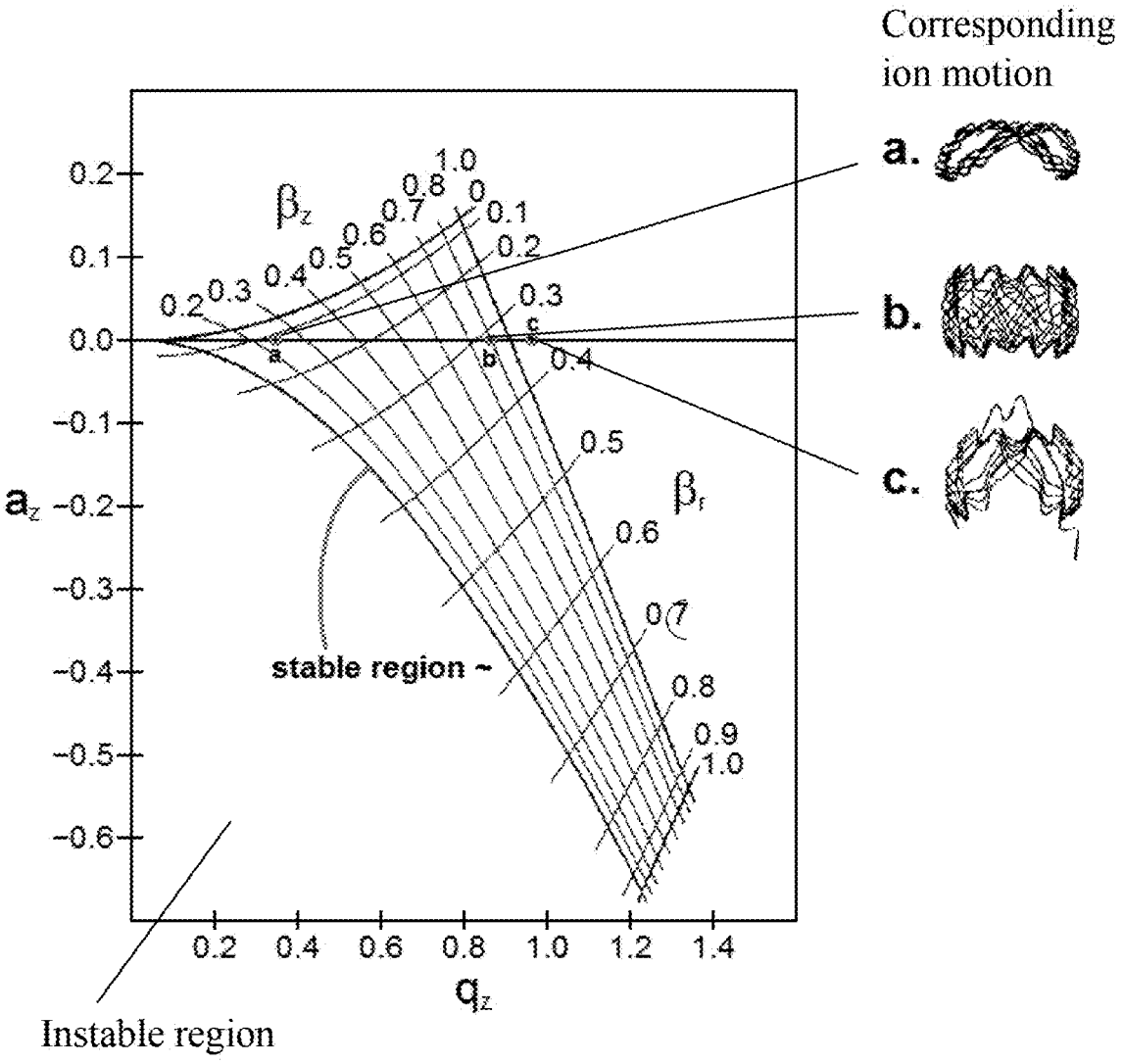
FIG. 1 PRIOR ART
FIG. 1 is a plot showing a q-a diagram for a conventional QIT mass spectrometer.
Figure 2:
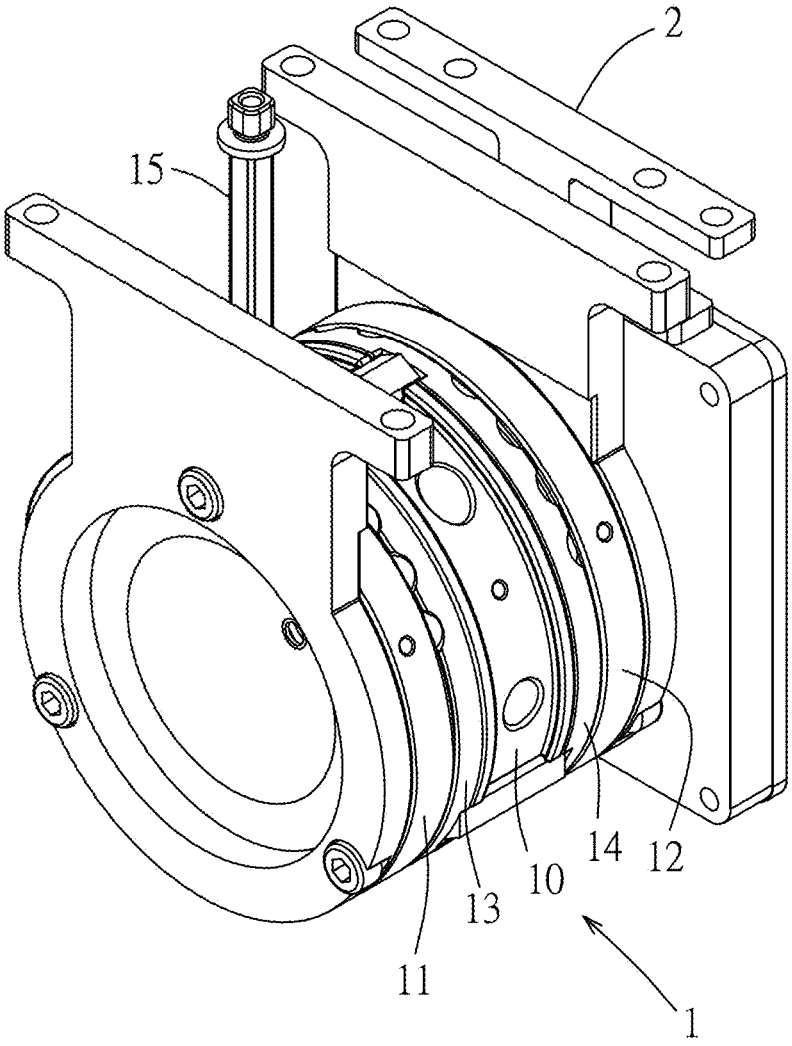
FIGS. 2 to 4 are respectively a perspective view, an exploded perspective view, and a side view illustrating an assembly of a QIT apparatus and a charge-sensing particle detector (CSPD) assembly of the embodiment of the QIT mass spectrometer according to the disclosure.
Figure 3:
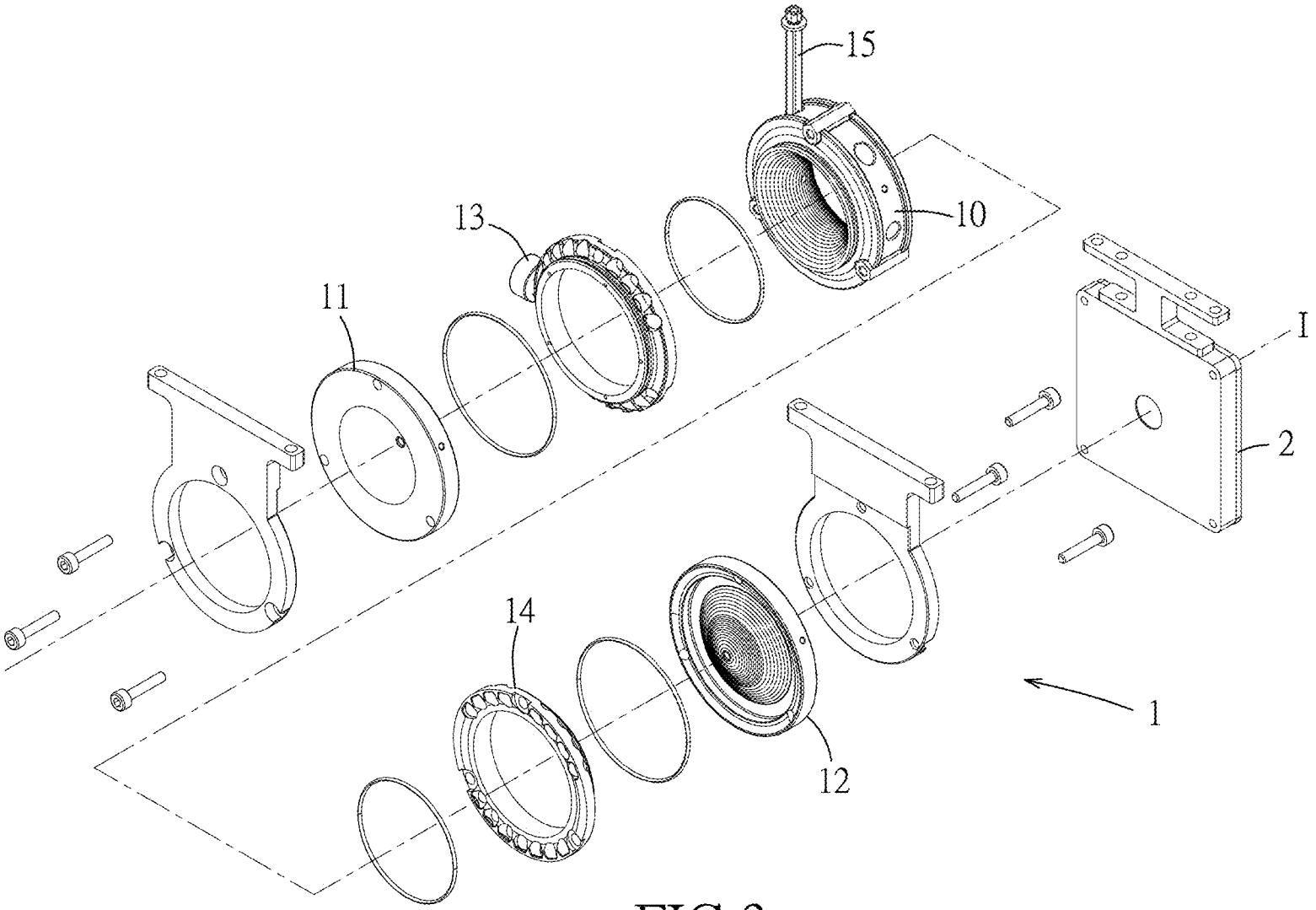
Figure 4:
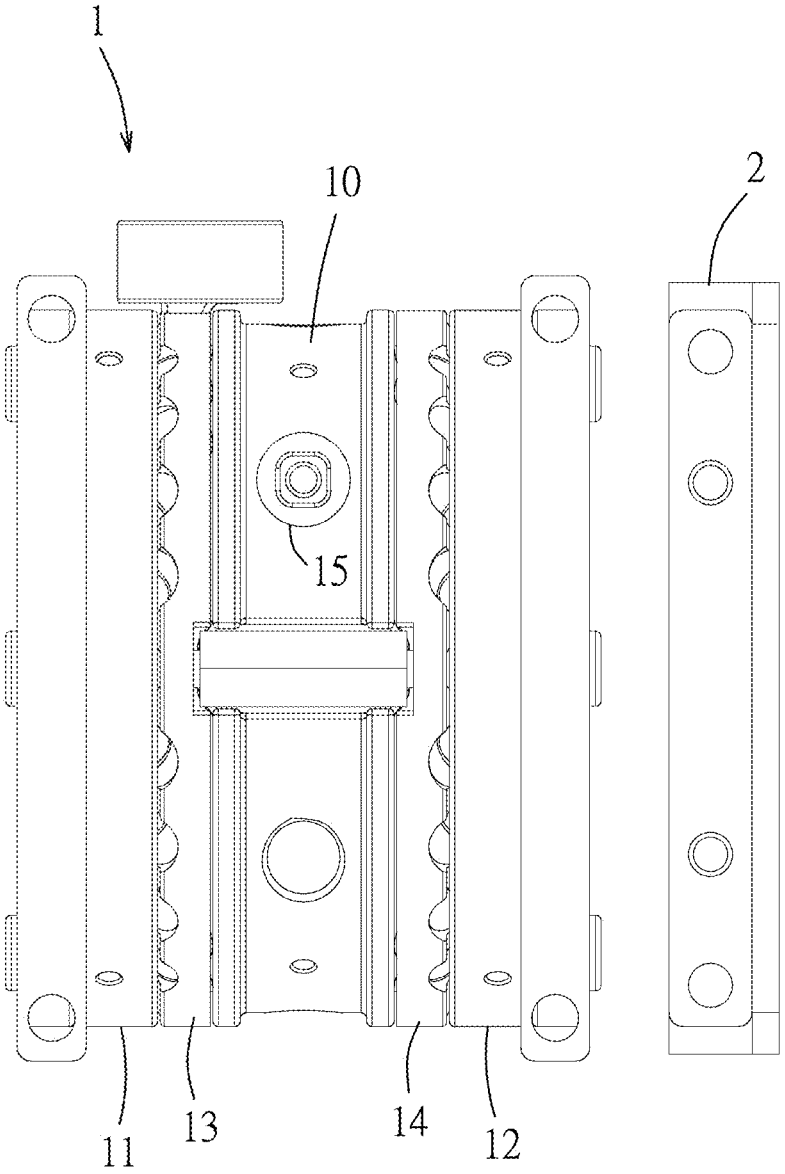
Figure 5:
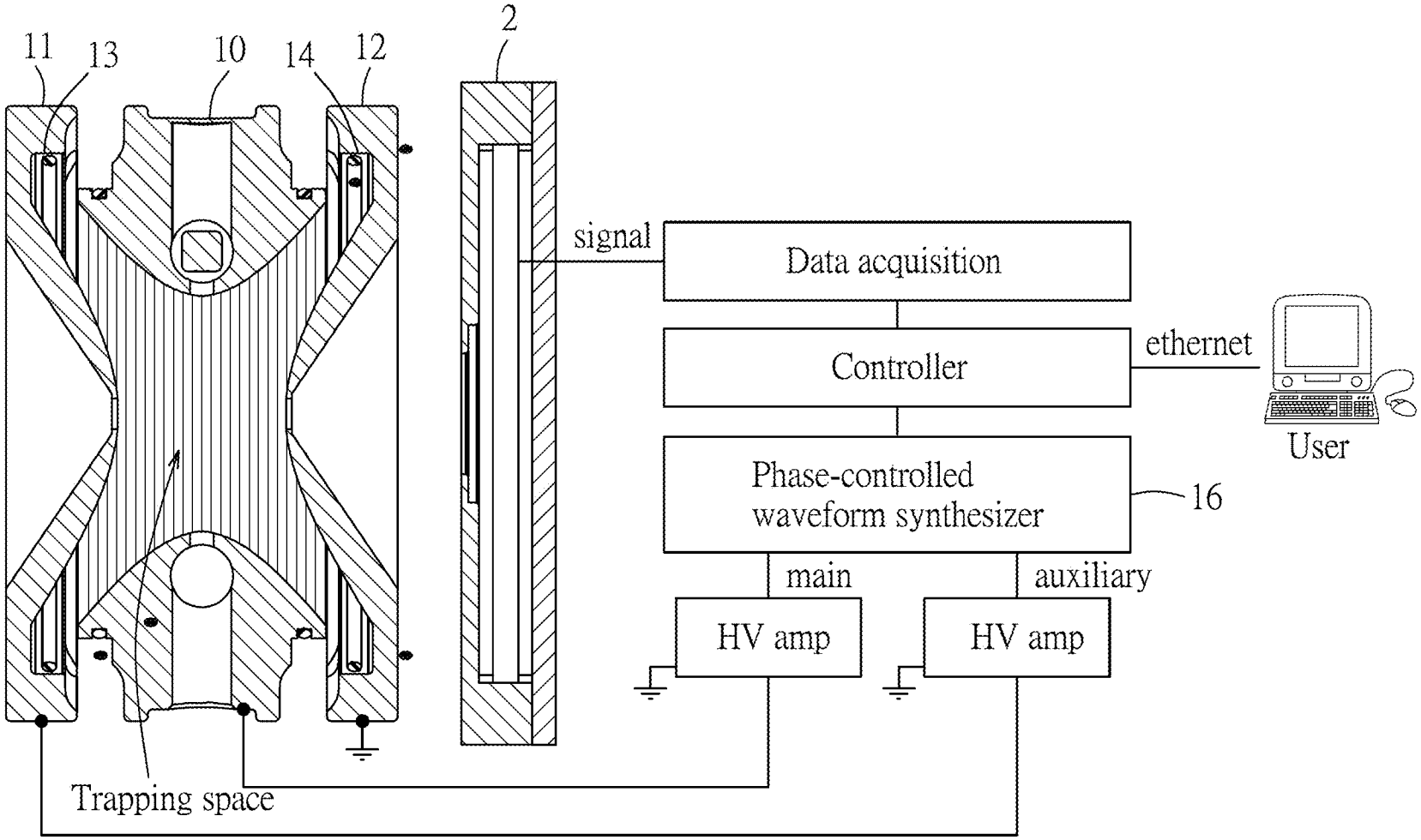
FIG. 5 is schematic view illustrating the embodiment.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 2 to 5, an embodiment of the QIT mass spectrometer includes a QIT apparatus 1 and a charge-sensing particle detector (CSPD) assembly 2. The QIT apparatus 1 includes a main electrode 10, a first end-cap electrode 11, a second end-cap electrode 12, a gas nozzle 13, a gas enclosure 14, a sample probe 15 and a phase-controlled waveform synthesizer 16.

In this embodiment, the main electrode 10 is a hyperbolic ring electrode that surrounds a QIT axis (I) extending along an axial direction, but this disclosure is not limited in this respect. The main electrode 10 has an electrode body formed with a laser inlet 101 (see FIG. 7), and two probe inlets 102 (see FIG. 7) that are spaced apart from each other. One of the probe inlets 102 is proximate to the laser inlet 101, and the other of the probe inlets 102 is distal from the laser inlet 101.

The first end-cap electrode 11 and the second end-cap electrode 12 are mounted at opposite sides of the main electrode 10 in the axial direction, and cooperate with an inner surface of the main electrode 10 to define a trapping space for trapping sample ions therein. In this embodiment, the first and second end-cap electrodes 11, 12 are hyperbolic electrodes, but this disclosure is not limited in this respect. The ions described herein can be ionized molecules or fragments of a larger molecule or structure selected from macromolecules, biomolecules, organic polymers, nanoparticles, proteins, antibodies, protein complexes, protein conjugates, nucleic acids, oligonucleotides, DNA, RNA, polysaccharides, viruses, cells, and biological organelles.

Figure 6:
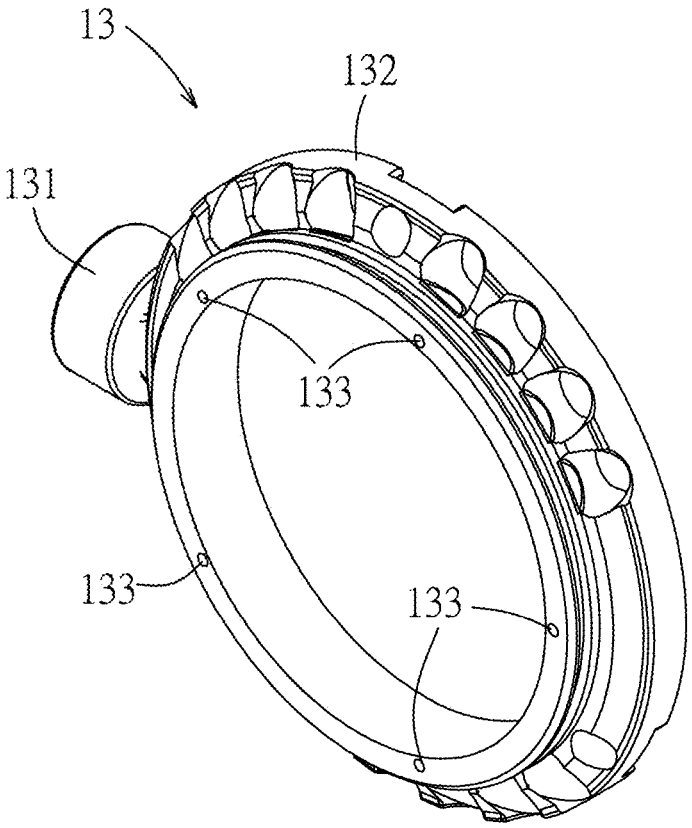
FIG. 6 is a perspective view illustrating a gas nozzle of the embodiment.

Further referring to FIG. 6, the gas nozzle 13 is in spatial communication with the trapping space for introducing buffer gas into the trapping space to generate an axial-flow jet that flows along the axial direction, so as to weaken the kinetic energy of the sample ions and slow down motions of the sample ions trapped in the trapping space by collisions with the buffer gas, and thus the sample ions may be collected closer to a center of the trapping space. In detail, the gas nozzle 13 is sandwiched between the first end-cap electrode 11 and the main electrode 10, and includes a gas inlet 131, and a tubular body 132 surrounding the QIT axis (I) (see FIG. 3). The tubular body 132 has an inner space in spatial communication with the gas inlet 131, and is formed with a plurality of jet outlets 133 that are in spatial communication with the inner space of the tubular body 132. The jet outlets 133 face toward the trapping space in the axial direction, and are symmetrically disposed on the tubular body 132 with respect to the QIT axis (I). The buffer gas enters the gas nozzle 13 from the gas inlet 131, and exits the gas nozzle 13 through the jet outlets 133 to form the axial-flow jet inside the trapping space. In some embodiments, the buffer gas is introduced into the trapping space before the sample ions enter the trapping space.

The gas enclosure 14 is sandwiched between the second end-cap electrode 12 and the main electrode 10 to cooperate with the gas nozzle 13 to form a substantially symmetric structure with respect to the main electrode 10.

Figure 7:
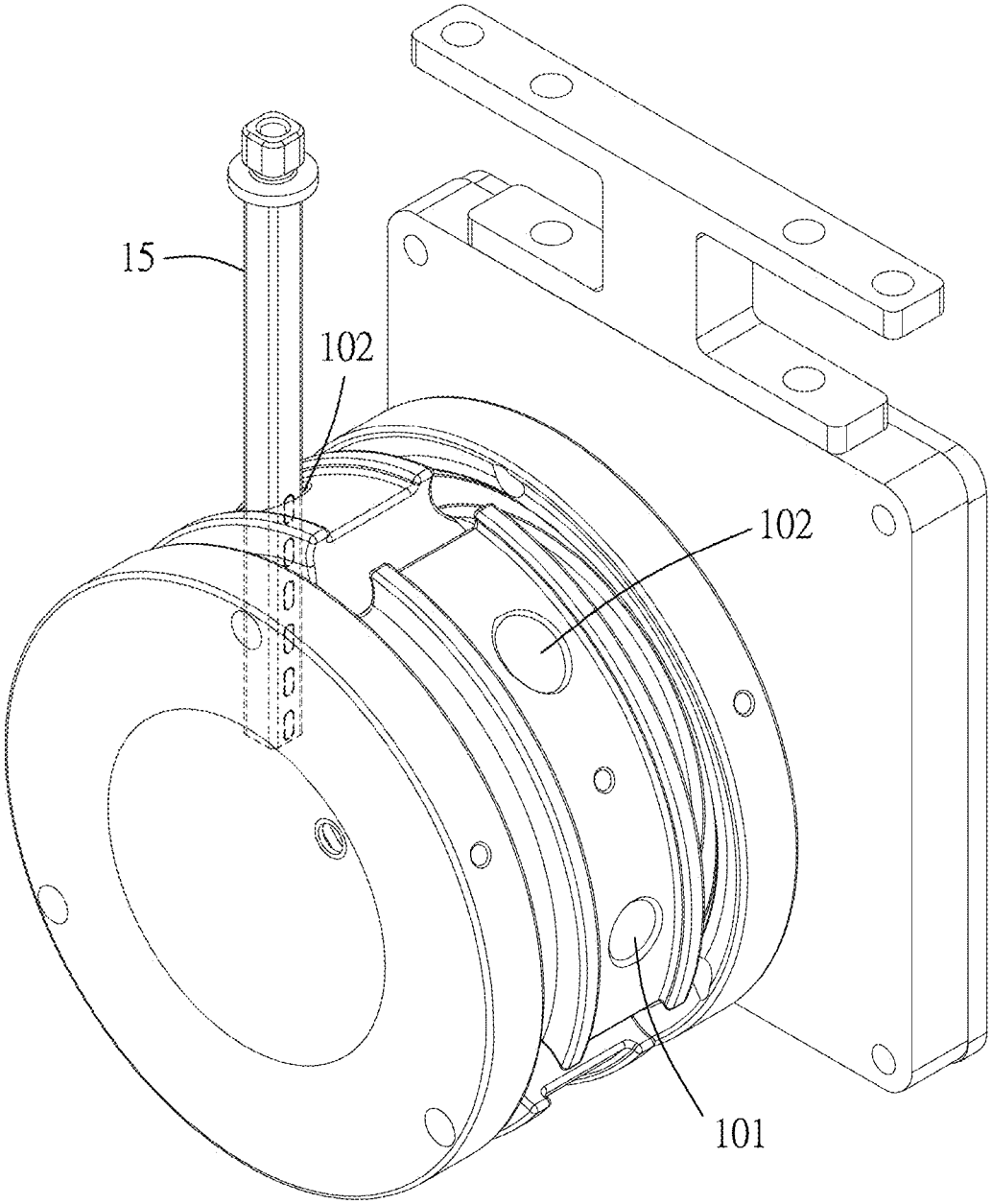
FIG. 7 is a perspective view illustrating an assembly of a sample probe and a main electrode of the embodiment.
Figure 8:
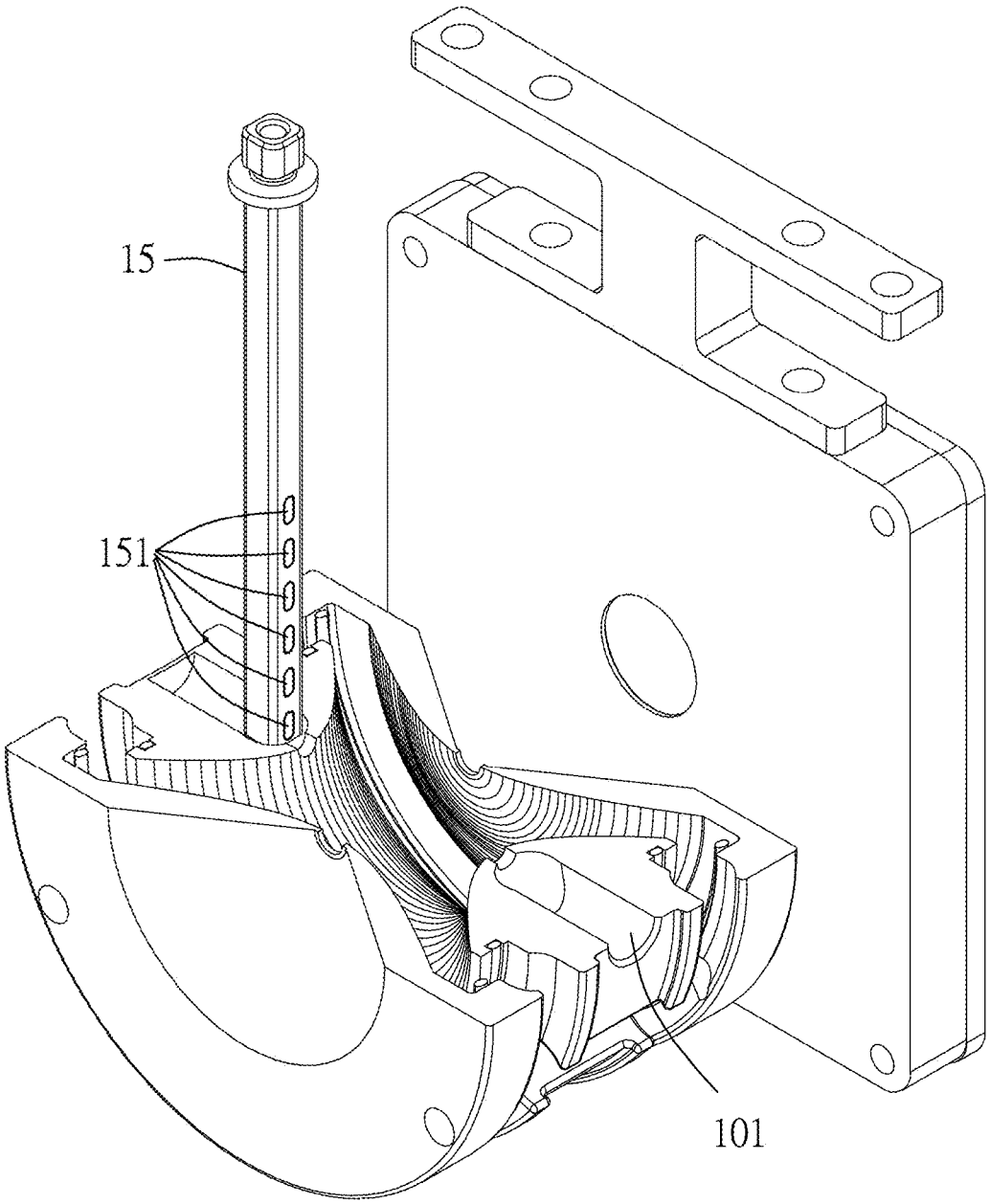
FIG. 8 is a perspective cutaway view of corresponding to FIG. 7.
Figure 10:
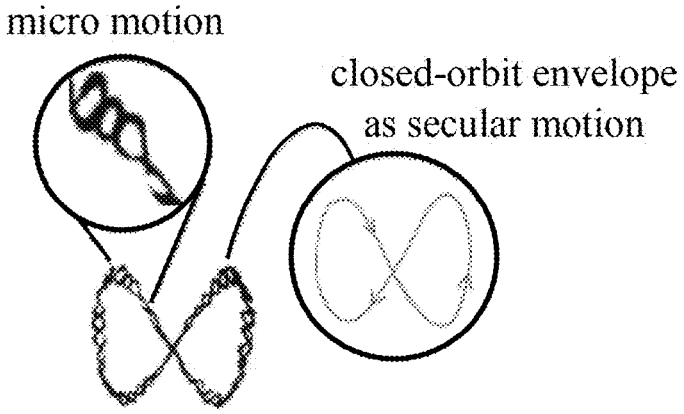
FIG. 10 is a schematic diagram illustrating micro motion and secular motion of an ion.

Further referring to FIGS. 7 and 8, the sample probe 15 has a tray portion formed with at least one sample tray configured for placing a sample (ion source) therein. In this embodiment, the sample probe 15 is a 1-dimensional probe formed with a plurality of sample trays 151 which are arranged along a lengthwise direction of the sample probe 15, and each of which has a respective tray opening. The sample is placed in the sample tray (s) 151 of the 1-dimensional sample probe 15 which is inserted into one of the 1-dimensional probe inlets 102, and is ionized using matrix-assisted laser desorption/ionization (MALDI). Over thousands of sample ions, singly- or doubly-charged, can be generated in the trapping space. These sample ions are in fact in the form of an ion cloud, with ions of the same mass-to-charge ratio to be ejected out of the QIT, and to be detected by the charge-sensing particle detector assembly 2. Since trapped ions are electrostatically correlated with each other, all phases of ion motion are at random in general, be it micro or secular ion motion/oscillation (see FIG. 10).

In use, the tray portion of the sample probe 15 is inserted into the main electrode 10 through one of the probe inlets 102 along an insertion direction (which is a vertical direction in FIG. 7) in such a way that the tray opening of one of the sample trays 151 faces toward the trapping space. In detail, the sample probe 15 extends in the insertion direction, is rotatable about a lengthwise axis thereof parallel to the insertion direction, and is linearly movable in the insertion direction, so that said one of the sample trays 151 can be adjusted to be aligned with the laser inlet 101 by rotation and/or linear movement of the sample probe 15, and laser pulses that are introduced in to the QIT apparatus 1 through the laser inlet 101 can thus fully access the sample in the sample tray 151. Accordingly, the sample in the sample tray 151 may be ionized by the laser pulses to generate sample ions which then enter the trapping space. It is noted that it would be easier for the ionized sample to enter the trapping space if the sample trays 151 are closer to the inner electrode surface of the main electrode 10 that cooperates with the first and second end-cap electrodes 11, 12 to define the trapping space. In this embodiment, a distance between the sample tray 151 in which the to-be-ionized sample is placed and the inner electrode surface of the main electrode 10 is not greater than one millimeter when the tray portion of the sample probe 15 is inserted into the main electrode 10. In one embodiment, the sample probe 15 is inserted into the probe inlet 102 that is distal from the laser inlet 101, so the laser pulses directly hit the sample to be ionized in the sample tray 151 that is aligned with the laser inlet 101 across the trapping space. In one embodiment, the sample probe 15 is inserted into the probe inlet 102 that is proximate to the laser inlet 101, so the laser pulses hit the sample probe 15 to ionize the sample in the sample tray 151 that is aligned with the laser inlet 101. In one embodiment, the sample probe 15 is transparent and is inserted into the probe inlet 102 that is proximate to the laser inlet 101, so the laser pulses hit the sample in the sample tray 151 that is aligned with the laser inlet 101 after passing through the transparent sample probe 15.

The phase-controlled waveform synthesizer 16 is electrically connected to the main electrode 10 and the first and second end-cap electrodes 11, 12, and is programmed to generate a main radio frequency (RF) waveform for the main electrode 10, and an auxiliary waveform for at least one of the first end-cap electrode 11 or the second end-cap electrode 12 (i.e., one or both of the first and second end-cap electrodes 11, 12).

Figure 9:
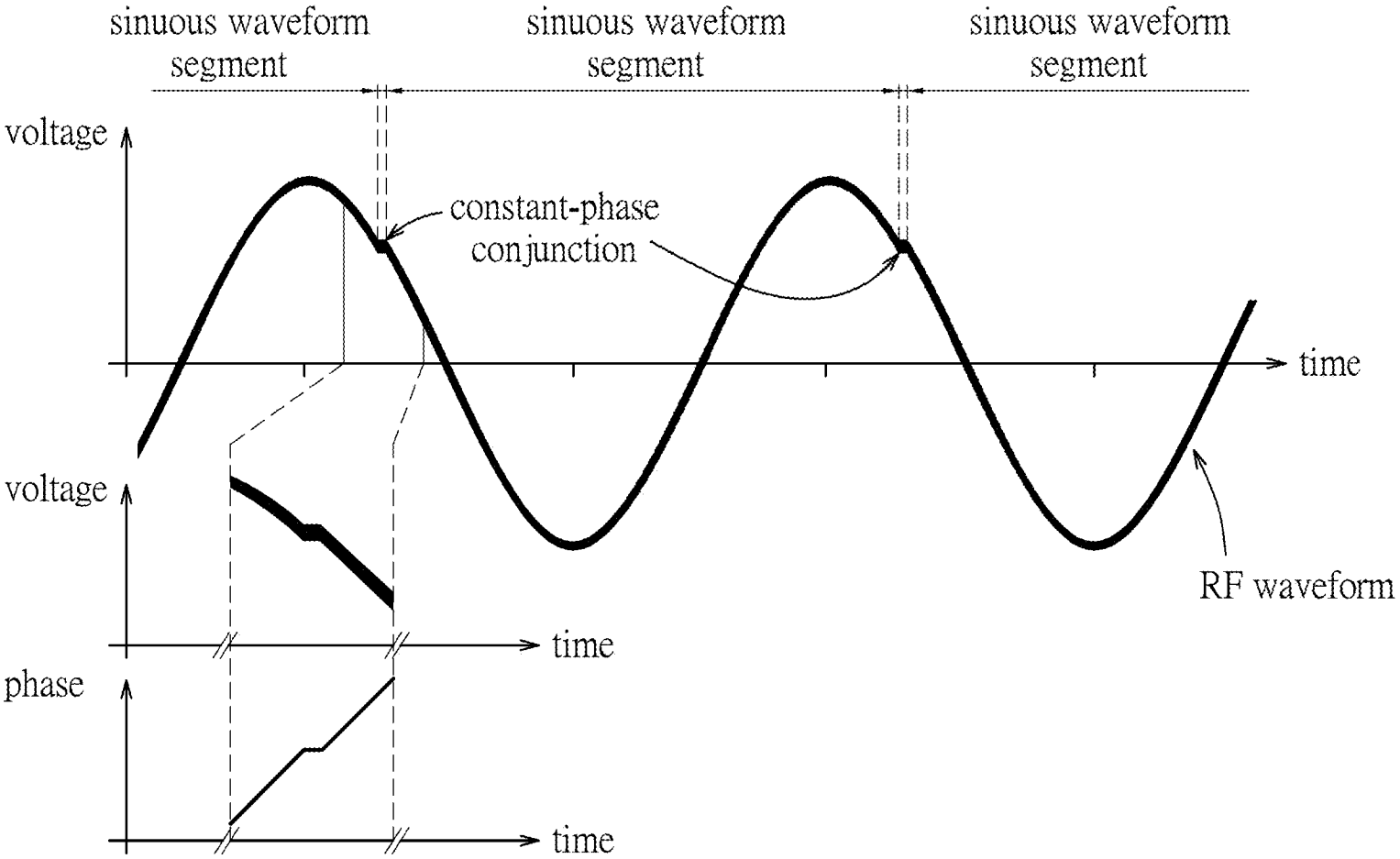
FIG. 9 is a plot illustrating a main RF waveform applied to the main electrode.

It is noted that the term "main RF waveform" used throughout the specification refers to a waveform applied to the main electrode 10, and is not limited to any specific waveform (shape). In this embodiment, in order to achieve the desired effect of this disclosure, the phase-controlled waveform synthesizer 16 is programmed such that the main RF waveform resembles a sine wave, but not a regular sine wave. Referring to FIG. 9, the main RF waveform includes a plurality of sinuous waveform segments each of which is a part of a sine wave, and a plurality of phase conjunction segments each of which is non-sinuous (not a part of a sine wave), wherein each of the sinuous waveform segments is bridged to another one of the sinuous waveform segments via one of the phase conjunction segments, so as to perform ordering of micro motions (see FIG. 10) of the sample ions trapped in the trapping space. The main RF waveform of this embodiment can be viewed as a sine wave being divided into multiple sinuous waveform segments, which are interconnected by the phase conjunction segments. Particularly, for each phase conjunction segment, the voltage of the main RF waveform is constant because the phase of the main RF waveform is constant during the period of the phase conjunction segment. In other words, any two of the sinuous waveform segments that are bridged by a phase conjunction segment are continuous in phase. This technique is called "constant-phase conjunction" herein.

As mentioned in the background section, conventionally, slow and smooth ramping in the main RE amplitude is used for linear mass spectrometry. On the other hand, using slow hopping in the main RF frequency for linear-scale mass spectrometry introduces irregular instability. "Smoother hopping in frequency does not necessarily bring about accurate mass spectra. Gradient of "frequency scan" (that is, the rate of change of frequency) strongly impacts ion motion, and therefore another dynamic deviation arises, and from the perspective of figure-of-merit histogram, such "frequency-scan" is not as simple as "amplitude-scan" in QIT MS.

As depicted by a basic Mathieu equation, the independent variable is not "time", but "main RF phase" which depends on time. The basic Mathieu equation, as a dynamical equation, is then generalized into a functional differential equation, including all higher order RF field modifications and explicit damping terms characterizing frequency dispersion and gas collisions (Equation (2)).

$$\frac{\delta^2 u}{\delta\xi(t)^2} + \left(a(\xi(t)) - \sum_{1}^{\infty} 2q_r(\xi(t)) \cdot \cos r2\xi(t)\right)u + \frac{\dot{\Omega}(t)}{\Omega(t)^2} \cdot \frac{\delta u}{\delta\xi(t)} + \frac{2\gamma}{\Omega(t)} \cdot \frac{\delta u}{\delta\xi(t)} = 0 \tag{2}$$

where r represents a number of modes of the main RF waveform (i.e., a number of frequencies of the main RF waveform used in frequency hopping for mass scan).

Therefore, the dynamics of trapped ions follow a damped Hill-Mathieu equation with implicit dependence on time. Regardless of whether the motion of trapped ion is stable or not, the dynamics can now be completely controlled by the RF waveform applied to the main electrode 10 via synthesis of the phase function of the RF waveform.

To preserve linear relationship between mass-charge-ratio and time during mass spectrometry upon the same Mathieu stability q-a diagram, the ideal damping-less LMZ envelope of the main RF phase can be derived in a closed form (Equation (3)):

$$2\xi(t) = 2\Omega_1\tau\frac{\Omega_2^2}{\Omega_1^2-\Omega_2^2}\left[\sqrt{\frac{t-T}{\tau}\frac{\Omega_1^2-\Omega_2^2}{\Omega_2^2}+1}-1\right]+\Omega_1 T, \tag{3}$$

where:

$t\in[T, \ldots, T+\tau]$: scan duration from $\Omega_1$ to $\Omega_2$ $\Omega_1$: initial scanning frequency of main RF waveform;

$\Omega_2$: final scanning frequency of main RF waveform;

T: time at which a frequency scanning from $\Omega_1$ to $\Omega_2$ begins;

$\tau$: duration of frequency scanning from $\Omega_1$ to $\Omega_2$;

Further, taking the interrupting ion-ion interactions into account, these ion-ion interactions, which stochastically cut off buffer-gas collisions, are re-formulated into the damping series of discrete buffer-gas collisions (see Equation (4)). The near-continuous cooling due to buffer gas is abruptly terminated by such ion-ion interaction of strength much greater than gas collisions.

$$\frac{\delta^2 u}{\delta\xi(t)^2}+\left(a(\xi(t))-\sum_1^\infty 2q_r(\xi(t))\cdot\cos r2\xi(t)\right)u+\left(\int^{t'}\frac{\dot\Omega(t')}{\Omega(t')^2}\cdot\delta(t,t')+2\cdot\frac{6\pi\eta R}{m\Omega(t')}\cdot[\Sigma_i\delta(t_i,t')]\cdot e^{-[Xion]\cdot(t-t')}\right)dt'\cdot\frac{\delta u}{\delta\xi(t)}=0 \tag{4}$$

where:

$\delta(t,t')$: delta function;

$t_1$: timing of gas collision event;

R: radius of molecular ion (sample ion);

$\eta$: viscosity coefficient of buffer gas; and $\chi_{ion}$: cut-off parameter (ion-ion interaction), which is an expectation value of ion intervening rate.

As a result, one formulation of mass spectrometry for ion cloud is developed, and is quite different from the simple Mathieu equation for the case with only a few trapped ions.

Since the main RF waveform is already sinuous or co-sinuous over phase, it is to periodically perturb the motion of each trapped ion so as to see if all ions can almost move in the same phase. The breakthrough is to apply an external constant-phase modulation of infinitesimal amount in terms of phase upon the main RE waveform and/or auxiliary waveform (see Equation (5)):

$$\frac{\delta^2 u}{\delta\xi(t)^2}+\left(a(\xi(t))-\sum_1^\infty 2q_r(\xi(t))\cdot\cos r2\xi(t)\right)u+\left(\int^{t'}\frac{\dot\Omega(t')}{\Omega(t')^2}\cdot\delta(t,t')+2\cdot\frac{6\pi\eta R}{m\Omega(t')}\cdot[\Sigma_i\delta(t_i,t')]\cdot e^{-[Xion]\cdot(t-t')}\right)dt'\cdot\frac{\delta u}{\delta\xi(t)}=\sum_j Con_j(\xi(t))\cdot\left[\left(a(\xi(t))-\sum_1^\infty 2q_r(\xi(t))\cdot\cos r2\xi(t)\right)-\left(a(\xi_j)-\sum_1^\infty 2q_r(\xi_j)\cdot\cos r2\xi_j\right)\right]u; \tag{5}$$

-continued $$Con_j(\xi)=1,\ \text{when}\ \xi=\xi_j(t);\quad Con_j(\xi)=0,\ \text{when}\ \xi=\text{else};\quad \text{s.t.},\ \frac{\delta u}{\delta\xi(t)}\bigg|_{\xi_j^-}^{\xi_j^+}=-(\xi_j^+-\xi_j^-)\cdot\left[\left(a(\xi_j)-\sum_1^\infty 2q_r(\xi_j)\cdot\cos r2\xi_j\right)\right]u,\quad \text{and}\ u\bigg|_{\xi_j^-}^{\xi_j^+}=0((\xi_j^+-\xi_j^-)^2) \tag{5.1}$$

where:

$Con_j(\xi)$: conjunction multiplier;

$t_j$: timing of gas collision event; and

O: omittable order.

For each applied constant-phase conjunction, each trapped ion has its position in motion nearly un-perturbed, yet promptly modulates the velocity of the ion motion a bit, according to the RF phase location of the conjunction (Equation (5.1)).

The basic principle of the modulation is to keep modulating all ions into highly synchronous motion via a mechanism similar to Landau damping. For the modulation in micro motion, the conjunctions are periodically applied to the main RF waveform at the phases corresponding to peaks and valleys of the main RF waveform, but this disclosure is not limited thereto. Thus, each ion's micro motion is gradually driven toward being of maximum speed and null displacement (i.e., at equilibrium). For the modulation in secular motion, off-resonant auxiliary RF pulses can be introduced at the phases with zero amplitudes (i.e., phase zero) of the main RF waveform. After the modulation, all ions of the same mass-to-charge ratio will progressively move as coherent as possible.

In the damping aspect of mass spectrometry, there are two important implications with the constant-phase conjunction modulation. The constant-phase conjunction modulation can steadily make the random ion-ion interaction become periodical, with short-term periodic regularity, such that the cut-off parameter of buffer-gas damping becomes finite and fixed with respect to time. Therefore, right after each conjunction, buffer-gas cooling becomes effective only for a finite duration. In addition, the constant-phase conjunction modulation can practically be dispersion-less and connect all in-between events (any process in MS) together as one Markov chain, such that the main RF waveform, right after each conjunction, can connect an arbitrary, e.g., "frequency-hop", process, without yielding any dispersive outcome.

In other words, by virtue of the phase conjunction, mass scan for mass spectrometry may be performed by frequency ramping/hopping of the main RF waveform instead of the conventional ramping in amplitude of the main RF waveform, wherein the adjustable magnification of the frequency is much higher than that of the amplitude in practice. During mass scan, application of the main RF waveform may be divided into multiple modulation periods. In different modulation periods, the main RF waveform may have different frequencies; a phase conjunction segment may be used to bridge the part of the main RF waveform that is in one modulation period and the part of the main RF waveform that is in another modulation period in which the frequency of the main RF waveform is different from that in said one modulation period. In this embodiment, for each modulation period, the phase conjunction segments are periodically distributed within the modulation period, such that the sample ions that have the same mass-to-charge ratio and that are trapped in the trapping space are phase-correlated and get ordering nearby local amplitude-zeros, but this disclosure is not limited in this respect. It is noted that there may be one or more phase conjunction segments in one sine-wave cycle, which is a cycle resembling a sine-wave when ignoring the phase conjunction segments. In one embodiment, the phase conjunction segments are arranged at the peak and valley of the corresponding sine wave. It is further noted that a length of each phase conjunction segment may be shorter than 5% of a period of the corresponding sine wave to obtain a better ordering of the micro motion of the ions, but this disclosure is not limited thereto because the technique of this disclosure is still workable when the length of the phase conjunction segment is longer than 5% of the period of the corresponding sine wave.

With the application of constant-phase conjunction modulation, the trapping and cooling of ions based on the QIT mass spectrometer of the present disclosure can be more effective and efficient, and the range of mass scan can be extended much wider and with better spectrometric linearity.

Figure 11:
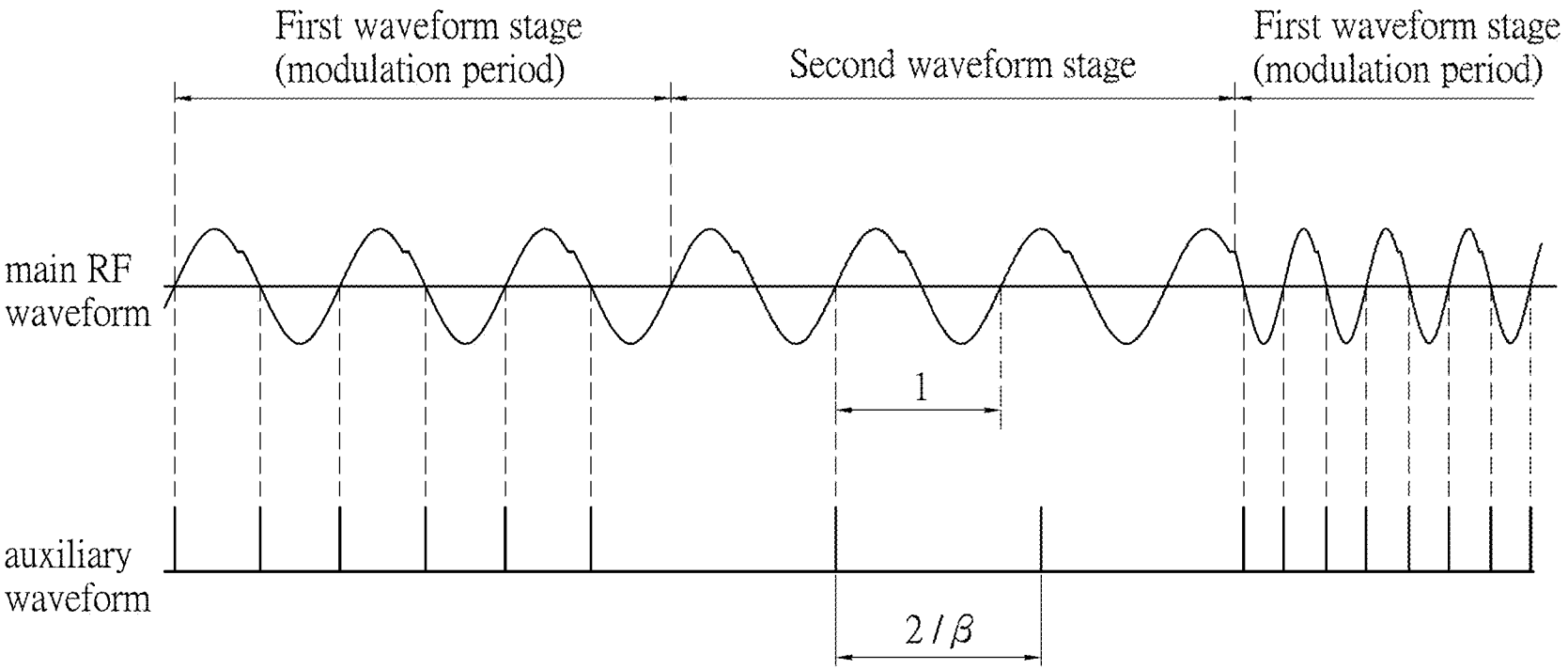
FIG. 11 is a plot illustrating the main RF waveform and an auxiliary waveform.
Figure 12:
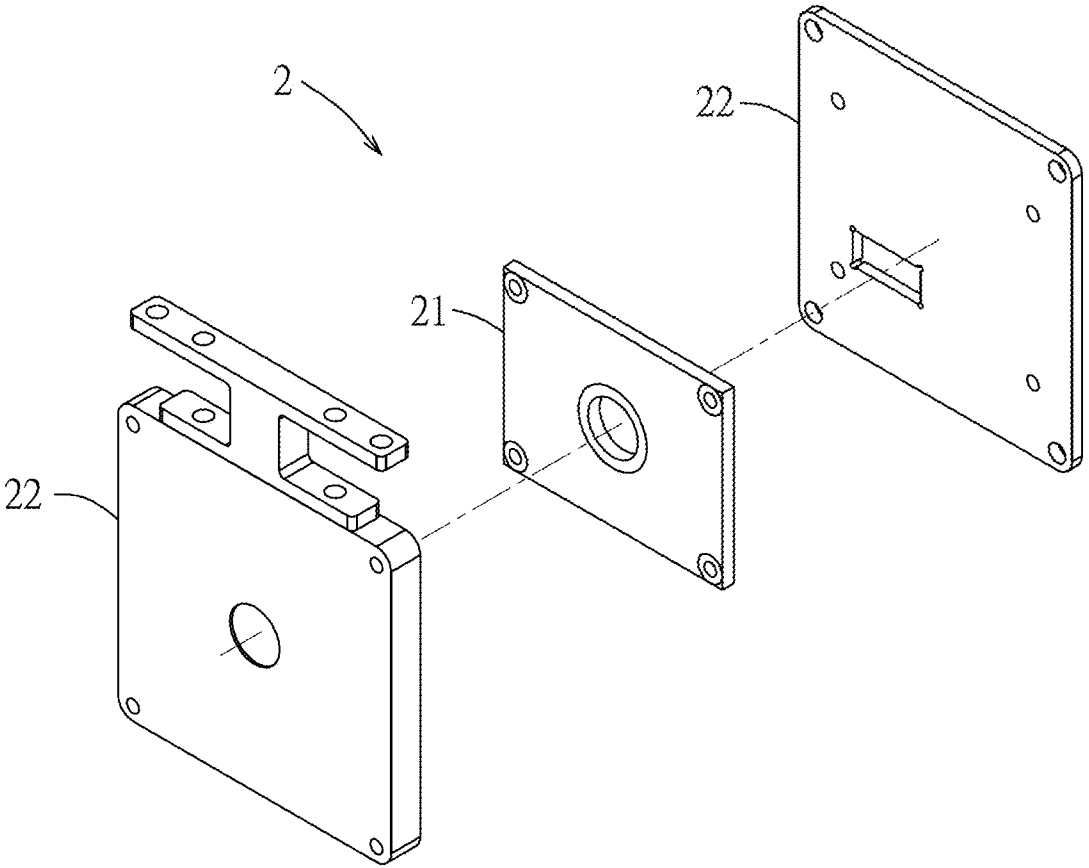
FIG. 12 is a perspective view illustrating the CSPD assembly.
Figure 18:
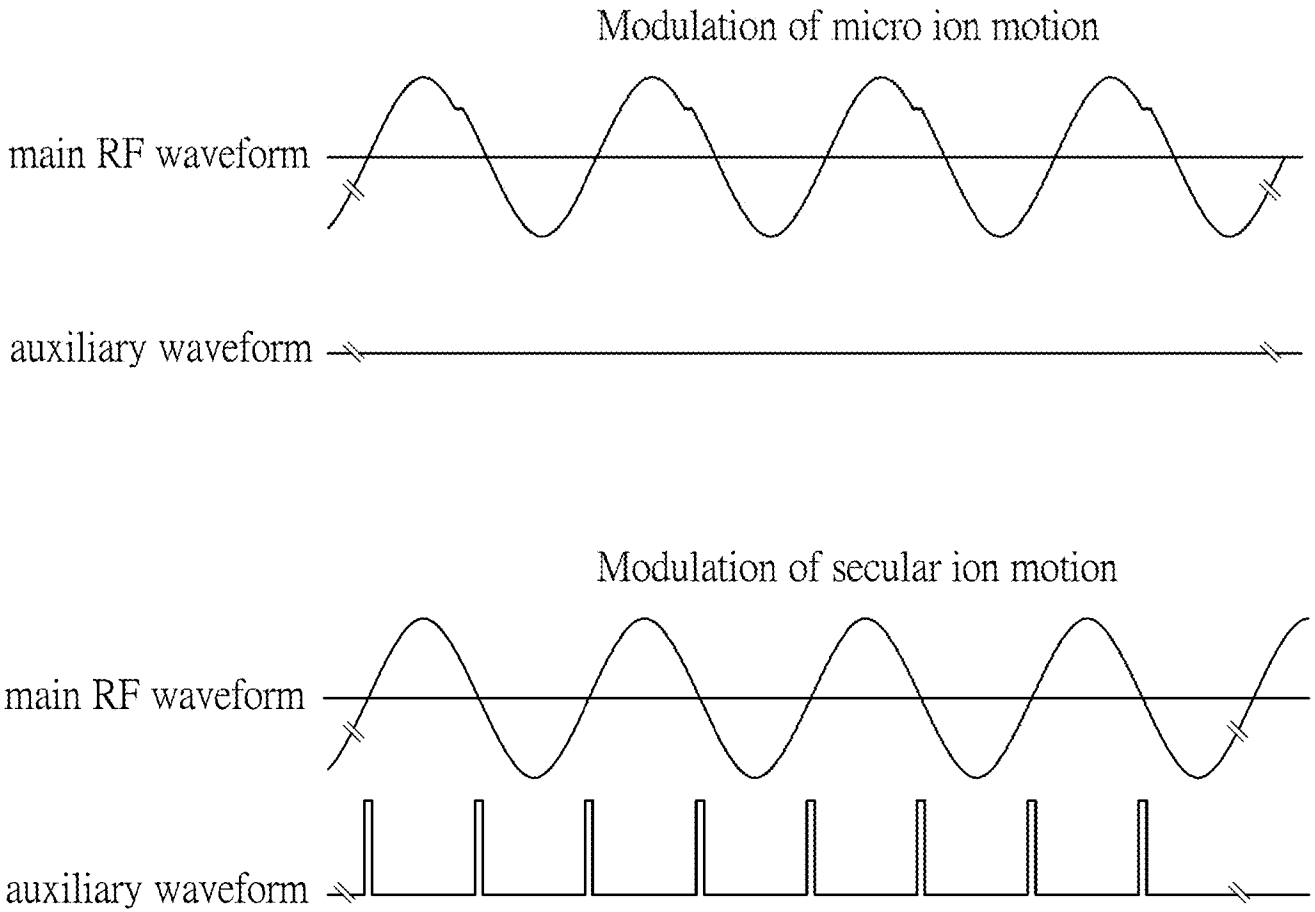
FIG. 18 is a plot illustrating another implementation of the main RF waveform and the auxiliary waveform.

Referring to FIG. 11, in this embodiment, the phase-controlled waveform synthesizer 16 is further programmed such that the auxiliary waveform includes a plurality of pulses. The auxiliary waveform may be classified into two waveform stages based on its function. In a first waveform stage, each of the pulses is arranged at a time at which a magnitude of the main RF waveform is zero, so as to perform ordering of secular motions of the sample ions trapped in the trapping space. Each pulse applied in the first waveform stage is called off-resonant auxiliary pulse. It is noted that modulation of the secular ion motion and modulation of the micro ion motion may be applied at the same time or separately. In a case that the modulations of the secular ion motion and the micro ion motion are performed separately, as shown in FIG. 18, the auxiliary waveform may be constant in voltage during the modulation of the micro ion motion; and the main RF waveform may be a pure sine wave during the modulation of the secular ion motion. In a second waveform stage of the auxiliary waveform, the pulses are arranged at a predetermined frequency, so as to cause resonance of the sample ions, thereby inducing or assisting the main RF waveform to induce election of the sample ions trapped in the trapping space out of the QIT apparatus 1.

Figure 13:
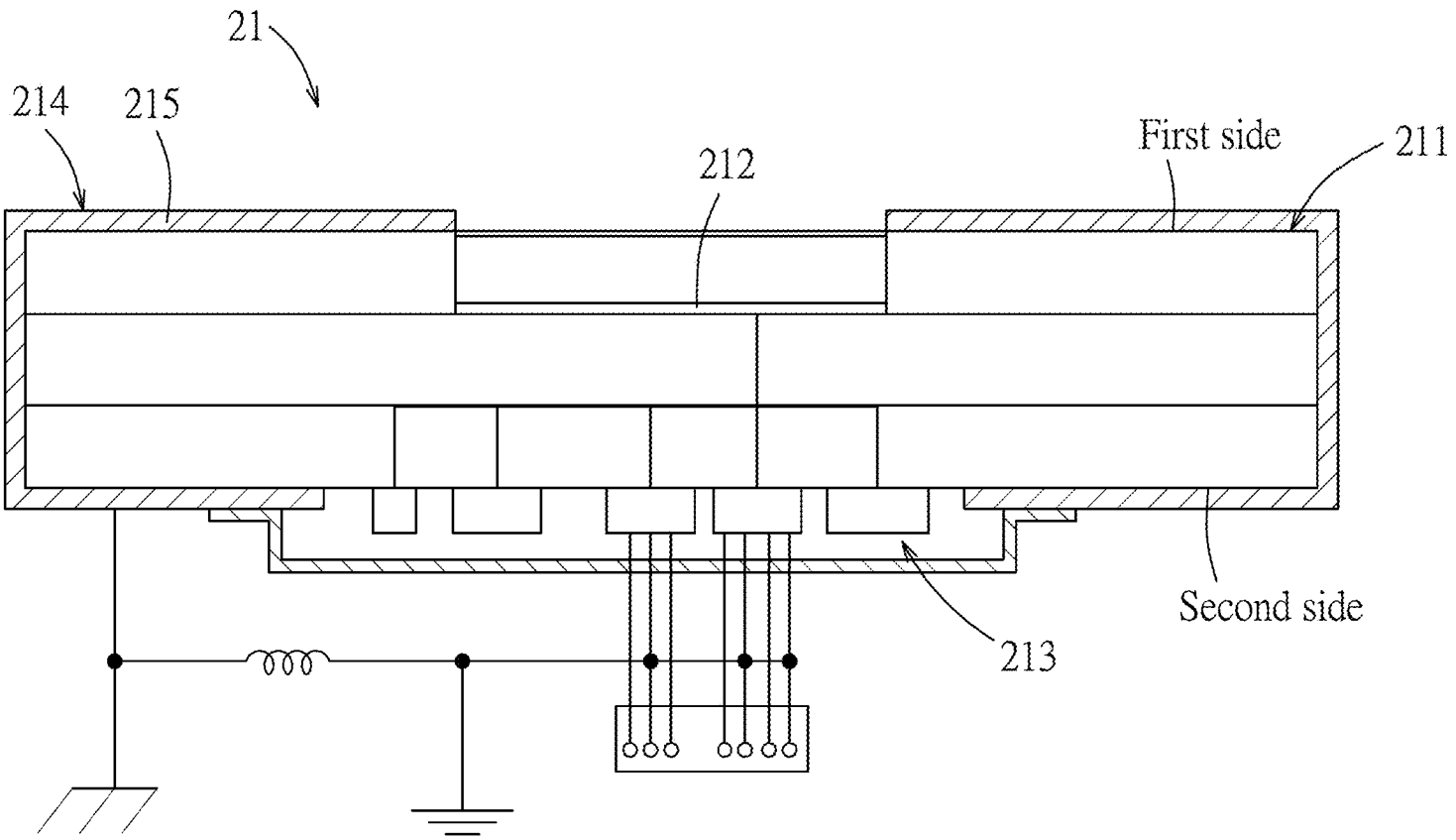
FIG. 13 is a schematic sectional view of a charge-sensing particle detector of the CSPD assembly.

Referring to FIGS. 2 to 4 and 12, the charge-sensing particle detector assembly 2 includes a charge-sensing particle detector 21 and two metal shields 22. The charge-sensing particle detector 21 is mounted to the second end-cap electrode 12 of the QIT apparatus 1 via the metal shields 22 to sense charges of the sample ions elected from the QIT apparatus 1, and includes a substrate 211, a charge detection plate 212, an integrated circuit unit 213 and an interference shielding unit 214, as shown in FIG. 13.

The charge detection plate 212 is disposed on a first side of the substrate 211. The charge detection plate 212 may be made of a conducting material, such as metal. In some embodiments, the charge detection plate 212 is made of copper. In some embodiments, the charge detection plate 212 is about 5-10, 10-15 or 15-20 mm in radius. In some embodiments, the charge detection plate 212 is of about 5 mm in radius. In some embodiments, the charge detection plate 212 may operate without charge amplification. In some embodiments, the charge detection plate 212 is useful for sensing and detecting ions by conducting image current of incident ions. In some embodiments, the charge detection plate 212 is used to conduct image current of incident ions from the QIT apparatus 1 within the range of about 10-20, 10-30, 10-40 or 10-50 mm away from the charge detection plate 212.

The integrated circuit unit 213 is electrically connected to the charge detection plate 212, and is disposed on a second side of the substrate 211 that is non-coplanar with the first side. The integrated circuit unit 213 disposed on the second side is non-coplanar with the charge detection plate 212 disposed on the first side so as to prevent interference on the integrated circuit unit 23 by the sample ions.

Figure 14:
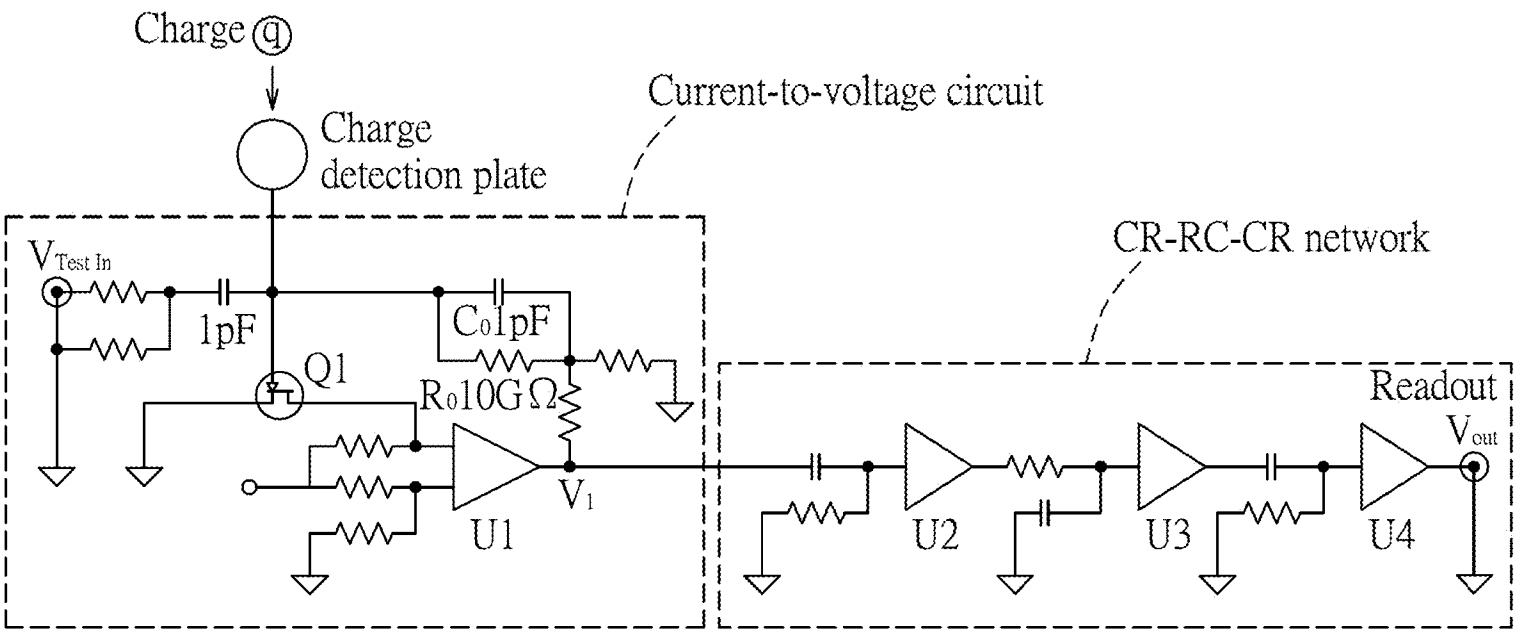
FIG. 14 is a circuit diagram depicting an exemplary implementation of an integrated circuit unit of the charge-sensing particle detector.
Figure 15A:
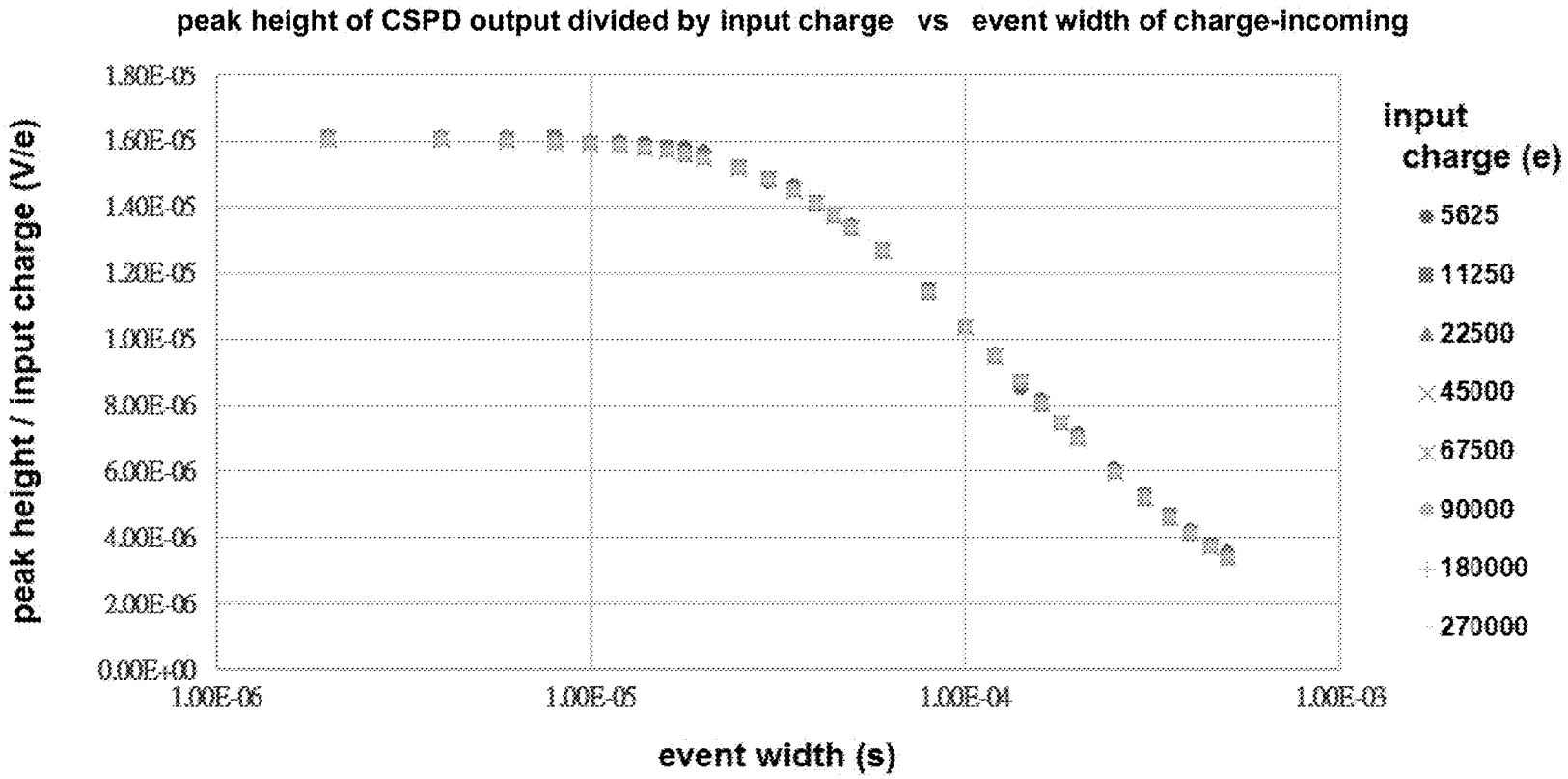
FIGS. 15A and 15B are plots illustrating a relationship between an event width of charge incoming and a ratio of a peak height generated by the CSPD to an input charge.
Figure 15B:
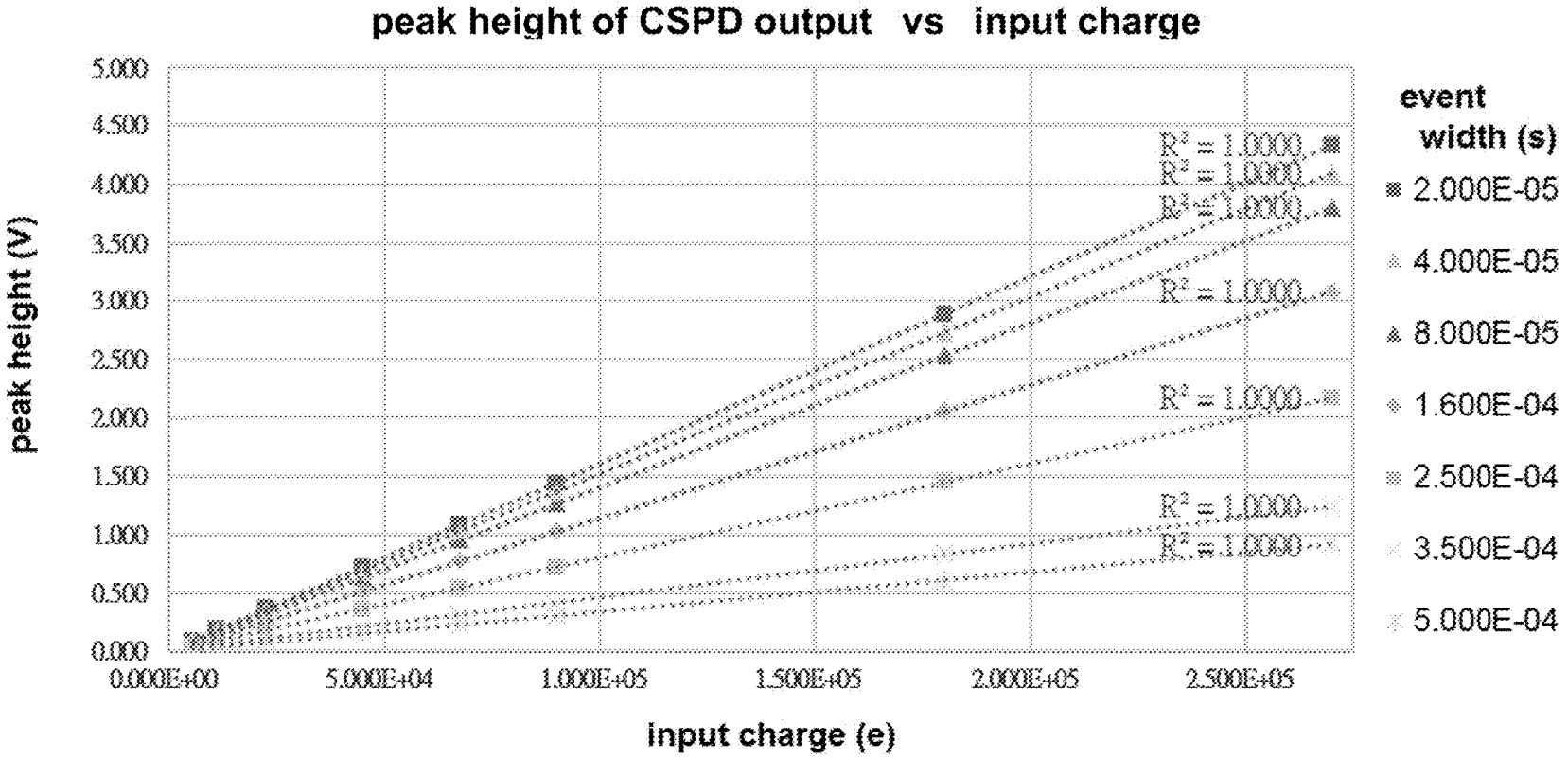

In this embodiment, the integrated circuit unit 213 is printed on a plastic circuit board, and is designed in situ for a point-like particle with more than 200 electron charges. The first stage of the integrated circuit unit 213 converts the incoming (induced or collected) charges into voltage. The integrated circuit unit 213 includes CR-RC-CR network (see FIG. 14) that is designed to have one simple zero nearby the asymptotically fastest pole of its transfer function, so as to re-shape the event of charge incoming (i.e., impingement of ions onto the charge detection plate 212) nonlinearly without introducing any overshooting. Referring to FIGS. 15A and 15B, an event width of charge incoming (a time length that the ion cloud impinges the charge detection plate 212) that is shorter than 10 μs may lead to a sharp and polarity-significant response.

The interference shielding unit 214 substantially encloses the charge detection plate 212 and the integrated circuit unit 23 in such a manner as to permit impingement on the charge detection plate 212 by the sample ions from the QIT apparatus 1 which is outside of the interference shielding unit 214. In detail, the interference shielding unit 214 includes a Faraday cage 215 that substantially covers the first and second sides of the substrate 211 and that has two openings respectively corresponding in position to the charge detection plate 212 and the integrated circuit unit 213 to respectively expose the charge detection plate 212 and the integrated circuit unit 213.

High-resolution mass spectrometry is achieved by piece-wisely modulating the phase-continuous RF waveforms on the main and auxiliary electrodes 10, 11, 12. The proposed procedure includes but is not limited to three processes: (1) efficient buffer-gas cooling of the ions while the ions are introduced into the QIT apparatus (2) phase-correlated ordering of the trapped ions during the phase modulation; and (3) damping-free frequency transitions of the main RF waveform for the trapped ions in each step of the mass scan.

For thousands of ions inside the QIT apparatus 1, the buffer-gas cooling is strongly intervened by ion-ion interactions in frequencies of the main RF overtones. The effectiveness and efficiency of cooling is achieved by generating a fast Knudsen flow along the axial pathway to the charge-sensing particle detector 21, such that there will be steady and sufficient collisions within a few main RF-cycles in a cooling session. One efficient buffer-gas cooling is composed of many cooling sessions bridged by constant-phase conjunctions at phase zero.

In one embodiment, following cooling, a series of conjunctions at peaks/valleys of the main RF waveform is used to modulate the micro motion of the ions so that the number of various phases of the micro motion is reduced to two. Next, all secular degrees of freedom are in tune via off-resonant auxiliary pulses. Such phase-correlated ordering then makes all cooled ions be synchronized both in micro and secular motion, so as to proceed with the following process of frequency transitions in the mass scan.

Right after cooling and ordering, all ions in the mass scan are subject to a series of frequency transitions that are bridged by constant-phase conjunctions as if no damping existed and all ions are in coherence. Hence, be it unstable or resonant, all ions to be ejected are almost in the same ideal motion which obeys the Mathieu equation, such that the ions aggregating to arrive at the charge-sensing particle detector 21 resulting in a highly concentrated first stage signal, and then nonlinearly shaped into a highly resolved pulse.

By virtue of the abovementioned three processes, the resolving power of the charge-sensing particle detector 21 can correspond with detection time of 20 μs, which corresponds to mass spectrometry having a nominal resolution of 10 Da over the mass range of 10k-100k Da. In some embodiments, the mass resolution of analytes can be enhanced to be over 500-1000 within a mass range of 500-500k Da.

Figure 16:
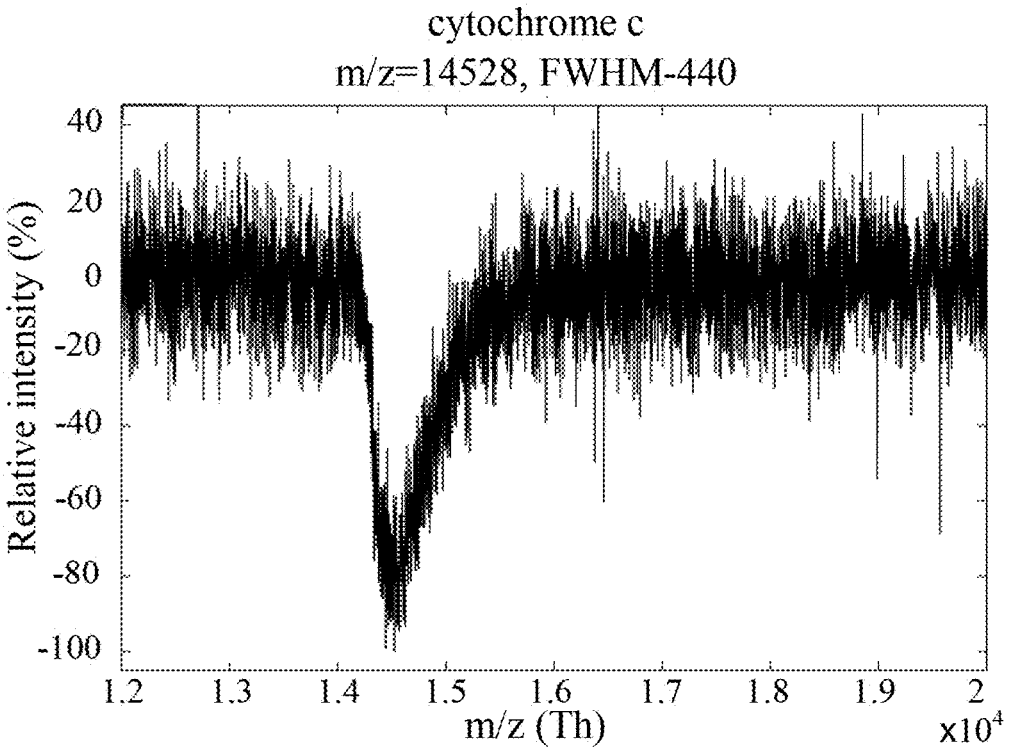
FIG. 16 is a plot illustrating a comparison between mass scan results acquired with and without applying constant-phase conjunction according to this disclosure.
Figure 16:
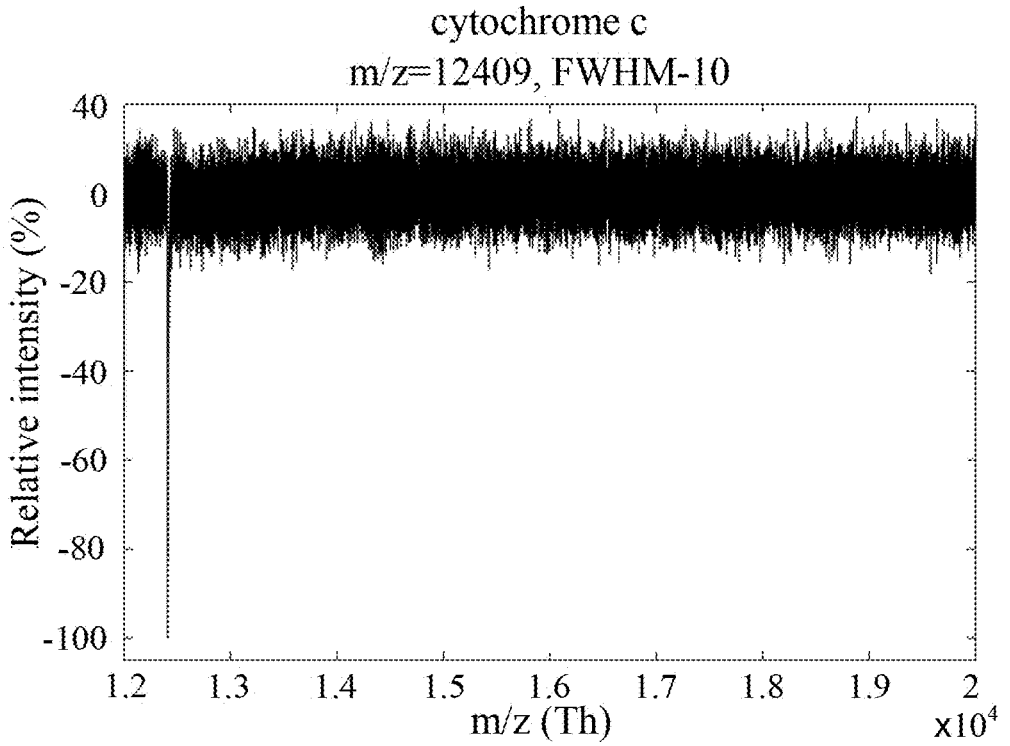

FIG. 16 shows comparison of mass scan results for cytochrome c, wherein the upper one is obtained without applying the constant-phase conjunctions, and the lower one is obtained with the constant-phase conjunctions being applied. It can be seen that, without applying the constant-phase conjunctions, the peak is deviated (the nominal value is 12327 Da) and the peak width is relatively wide (i.e., resolution is low). Having applied the constant-phase conjunctions, the mass scan result is more accurate and has higher resolution.

Figure 17:
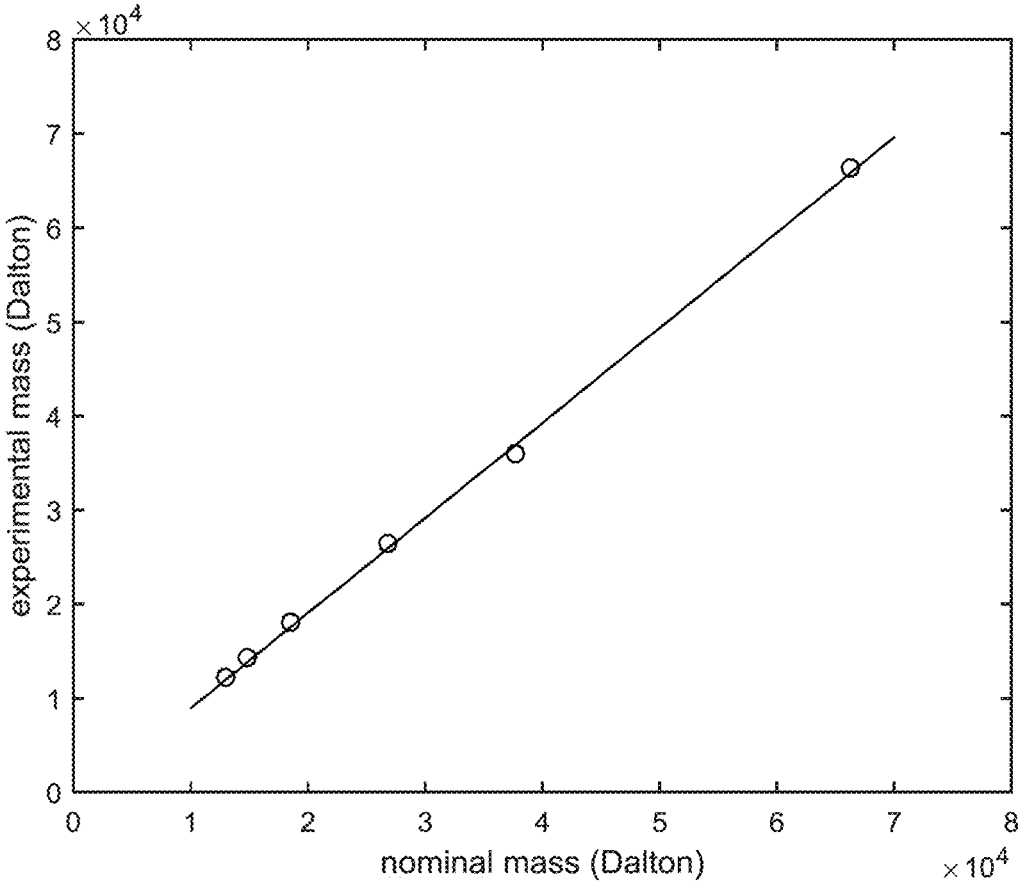
FIG. 17 is a plot illustrating a relationship between nominal mass and experimental mass of which data is obtained using the embodiment.

FIG. 17 shows a relationship between nominal mass and experimental mass of which data is obtained using the embodiment of this disclosure. It can be seen that the embodiment of this disclosure may lead to high accuracy for mass spectrometry.

It is noted that, in some embodiments, the main electrode 10 and the end-cap electrodes 11, 12 of the QIT apparatus 1 are made to have precision measured in standard deviation (SD) of about 3 μm and a roughness (Ra) less than 100 nm, and the main electrode 10 and the end-cap electrodes 11, 12 are assembled in the QIT apparatus 1 with an assembling deviation less than 5 nm, so as to achieve the abovementioned effects and the expected performance.

In some practices, the QIT mass spectrometer and method according to this disclosure may be useful for detecting biomolecules such as proteins, antibodies, protein complexes, protein conjugates, nucleic acids, oligonucleotides, DNA, RNA, polysaccharides and many others to characterize molecular weight, products of protein digestion, proteomic analysis, metabolomics, and peptide sequencing, among other things with high detection efficiency and resolution.

In some practices, the QIT mass spectrometer and method according to this disclosure may be used to obtain the mass spectra of nanoparticles, viruses, and other biological components and organelles having sizes in the range of up to about 50 nanometers or greater.

In some variations, the QIT mass spectrometer and method according to this disclosure can also provide mass spectra of small molecule ions.

In summary, the QIT mass spectrometer according to this disclosure can yield non-scattered spectral outcome without substantial deviations. The spectral outcome of the QIT mass spectrometer results in an enhanced mass resolution for molecules, macromolecules and biomolecules.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A quadrupole ion trap (QIT) apparatus, comprising: a main electrode that surrounds a QIT axis extending along an axial direction; and a first end-cap electrode and a second end-cap electrode mounted to opposite sides of said main electrode in the axial direction, and cooperating with said main electrode to define a trapping space for trapping sample ions therein; and a phase-controlled waveform synthesizer electrically connected to said main electrode, and configured to generate a main radio frequency (RF) waveform for said main electrode;

wherein the main RF waveform includes a plurality of sinuous waveform segments each of which is a part of a sine wave, and a plurality of phase conjunction segments each of which is non-sinuous;

wherein each of the sinuous waveform segments is bridged to another one of the sinuous waveform segments via one of the phase conjunction segments, so as to perform ordering of micro motions of the sample ions trapped in said trapping space;

wherein any two of the sinuous waveform segments that are bridged by the phase conjunction segment are configured to be continuous in phase, such that each of the phase conjunction segments is constant in voltage;

wherein the phase conjunction segments are periodically distributed within at least one modulation period, such that the sample ions trapped in said trapping space are phase-correlated and get ordering nearby local amplitude-zeros.

2. The QIT apparatus of claim 1, wherein the at least one modulation period includes at least two modulation periods in which the main RF waveform has different frequencies, respectively; and wherein one of the phase conjunction segments bridges one part of the main RF waveform that is in one of the at least two modulation periods and another part of the main RF waveform that is in the other one of the at least two modulation periods.

3. The QIT apparatus of claim 2, wherein said phase-controlled waveform synthesizer is further electrically connected to at least one of said first end-cap electrode or said second end-cap electrode, and is configured to generate an auxiliary waveform for said at least one of said first end-cap electrode or said second end-cap electrode;

wherein the auxiliary waveform includes a plurality of pulses arranged at a predetermined frequency, so as to assist ejection of the sample ions trapped in said trapping space out of said QIT apparatus.

4. The QIT apparatus of claim 1, wherein said phase-controlled waveform synthesizer is further electrically connected to at least one of said first end-cap electrode or said second end-cap electrode, and is configured to generate an auxiliary waveform for said at least one of said first end-cap electrode or said second end-cap electrode; wherein the auxiliary waveform includes a plurality of pulses arranged at a predetermined frequency, so as to induce ejection of the sample ions trapped in said trapping space out of said QIT apparatus.

5. The QIT apparatus of claim 1, wherein said phase-controlled waveform synthesizer is further electrically connected to one of said first and second end-cap electrodes, and is configured to generate an auxiliary waveform for said one of said first and second end-cap electrodes; wherein the auxiliary waveform includes a plurality of pulses each of which is at a time at which a magnitude of the main RF waveform is zero, so as to perform ordering of secular motions of the sample ions trapped in said trapping space.

6. The QIT apparatus of claim 1, further comprising a gas nozzle in spatial communication with said trapping space for introducing buffer gas into said trapping space to generate an axial-flow let that flows along the axial direction, so as to slow down motions of the sample ions trapped in said trapping space by collisions with the buffer gas.

7. The QIT apparatus of claim 6, wherein the buffer gas is introduced into said trapping space before the sample ions enter said trapping space.

8. The QIT apparatus of claim 6, wherein said gas nozzle includes a gas inlet, and a tubular body surrounding the QIT axis and formed with a gas flow path therein, the gas flow path being in spatial communication with said gas inlet;

wherein said tubular body is further formed with a plurality of jet outlets that are in spatial communication with said gas flow path, that face toward said trapping space in the axial direction, and that are symmetrically disposed on said tubular body with respect to the QIT axis, wherein the buffer gas enters said gas nozzle from said gas inlet, and exits said gas nozzle through said jet outlets to form the axial-flow jet inside said trapping space.

9. The QIT apparatus of claim 6, wherein said gas nozzle is sandwiched between said first end-cap electrode and said main electrode.

10. The QIT apparatus of claim 1, further comprising a sample probe that has a tray portion formed with at least one sample tray, each of said at least one sample tray being configured for placing a sample therein, and having a tray opening;

wherein said tray portion is inserted into said main electrode along an insertion direction in such a way that said tray opening faces toward said trapping space; and wherein said main electrode is formed with a laser inlet aligned with said at least one sample tray when said tray portion is inserted into said main electrode, so that the sample ions are generated from the sample by introduction of a laser pulse into said QIT apparatus through said laser inlet.

11. The QIT apparatus of claim 10, wherein said sample probe extends in the insertion direction, is rotatable about a lengthwise axis thereof parallel to the insertion direction, and is linearly movable in the insertion direction, so that said at least one sample tray can be adjusted to be aligned with said laser inlet.

12. The QIT apparatus of claim 10, wherein said main electrode has an inner electrode surface that cooperates with said first and second end-cap electrodes to define said trapping space; and wherein a distance between said at least one sample tray and said inner electrode surface of said main electrode is not greater than one millimeter when said tray portion of said sample probe is inserted into said main electrode.

13. A quadrupole ion trap (QIT) mass spectrometer, comprising:

a QIT apparatus of claim 1; and a charge-sensing particle detector (CSPD) mounted to said second end-cap electrode of said QIT apparatus to sense charges of the sample ions ejected from said QIT apparatus.

14. The QIT mass spectrometer of claim 13, wherein said charge-sensing particle detector includes:

a substrate;

a charge detection plate disposed on a first side of said substrate;

an integrated circuit unit electrically connected to said charge detection plate, and disposed on a second side of said substrate that is non-coplanar with said first side; and an interference shielding unit substantially enclosing said charge detection plate and said integrated circuit unit in such a manner as to permit impingement on said charge detection plate by the sample ions from outside of said interference shielding unit;

wherein said integrated circuit unit disposed on said second side is non-coplanar with said charge detection plate disposed on said first side so as to prevent interference on said integrated circuit unit by the sample ions.

15. The QIT mass spectrometer of claim 14, wherein said interference shielding unit includes a Faraday cage that substantially covers said first and second sides of said substrate and that has two openings respectively corresponding in position to said charge detection plate and said integrated circuit unit to respectively expose said charge detection plate and said integrated circuit unit.

16. The QIT mass spectrometer of claim 14, wherein said charge detection plate operates without charge amplification.

17. The QIT mass spectrometer of claim 14, wherein said charge detection plate is capable of conducting image current of incident ions from said QIT apparatus within the range of about 10 to 50 mm away from said charge detection plate.

* * * * *